US009666351B2

(12) United States Patent
Larsson

(10) Patent No.: US 9,666,351 B2
(45) Date of Patent: May 30, 2017

(54) DEVICE COMPRISING A HIGH VOLTAGE APPARATUS INCLUDING A FLUID AND EQUIPMENT FOR DETECTING ONE OR MORE PHYSICAL PROPERTIES OF THE FLUID

(71) Applicant: ABB Schweiz AG, Baden (CH)

(72) Inventor: Tommy Larsson, Ludvika (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/106,043

(22) PCT Filed: Jan. 20, 2015

(86) PCT No.: PCT/EP2015/050997
§ 371 (c)(1),
(2) Date: Jun. 17, 2016

(87) PCT Pub. No.: WO2015/110422
PCT Pub. Date: Jul. 30, 2015

(65) Prior Publication Data

US 2016/0322151 A1 Nov. 3, 2016

(30) Foreign Application Priority Data

Jan. 22, 2014 (EP) ..... 14152120

(51) Int. Cl.
*H01F 27/08* (2006.01)
*H01F 27/12* (2006.01)
(Continued)

(52) U.S. Cl.
CPC ..... *H01F 27/12* (2013.01); *H01F 27/00* (2013.01); *H01F 27/004* (2013.01); *H01F 27/02* (2013.01);
(Continued)

(58) Field of Classification Search
CPC ..... H01F 27/00–27/35
(Continued)

(56) References Cited

U.S. PATENT DOCUMENTS 4,402,211 A 9/1983 Sugawara et al.
5,946,171 A * 8/1999 Magnier ..... H01F 27/14 361/115
(Continued)

FOREIGN PATENT DOCUMENTS

CH 212727 A 12/1940
EP 2490011 A1 8/2012
(Continued)

OTHER PUBLICATIONS

European Search Report Application No. 14152120.3 Completed: Jul. 10, 2014; Mailing Date: Jul. 17, 2014 6 pages.
(Continued)

*Primary Examiner* — Tuyen Nguyen
(74) *Attorney, Agent, or Firm* — Whitmyer IP Group LLC

(57) ABSTRACT

A device including a high voltage apparatus enclosing a fluid for providing cooling and/or electrical insulation of the apparatus, and a detector for one or more physical properties of the fluid positioned spaced apart from the housing. The device includes a pipe assembly for housing a fluid, whereby the pipe assembly is arranged between the detector equipment and the housing such that the fluid is extended without interruption in the pipe assembly. The fluid in the pipe assembly is in communication with the fluid in the housing, and the detector equipment is in direct communication with the fluid in the pipe assembly. The detector equipment is positioned below a top level of the housing and at a safe distance from the housing of the apparatus, which makes it possible to carry out inspection, testing, maintenance, and
(Continued)

calibration of the detector equipment without taking the high voltage apparatus out of operation.

18 Claims, 3 Drawing Sheets

(51) Int. Cl.

| | |
|---|---|
| ***H01F 27/06*** | (2006.01) |
| ***H01F 27/02*** | (2006.01) |
| ***H01F 27/00*** | (2006.01) |
| ***H01F 27/10*** | (2006.01) |
| ***H01F 27/40*** | (2006.01) |
| ***H01F 27/20*** | (2006.01) |
| ***H01H 9/00*** | (2006.01) |
| ***H01H 9/52*** | (2006.01) |

(52) U.S. Cl.
CPC ..... *H01F 27/06* (2013.01); *H01F 27/08* (2013.01); *H01F 27/10* (2013.01); *H01F 27/20* (2013.01); *H01F 27/40* (2013.01); *H01H 9/0044* (2013.01); *H01H 9/52* (2013.01); *H01F 2027/404* (2013.01)

(58) Field of Classification Search
USPC ..... 336/55–62
See application file for complete search history.

(56) References Cited

U.S. PATENT DOCUMENTS

| | | | | |
|---|---|---|---|---|
| 2005/0103195 | A1 | 5/2005 | Golner | |
| 2007/0001793 | A1* | 1/2007 | Magnier | H01F 27/402 336/90 |
| 2011/0093216 | A1 | 4/2011 | Andersson et al. | |
| 2012/0024187 | A1 | 2/2012 | Beck | |
| 2012/0242443 | A1* | 9/2012 | Magnier | H01H 9/0005 336/90 |

FOREIGN PATENT DOCUMENTS

| | | | | |
|---|---|---|---|---|
| JP | S56101718 | A | | 8/1981 |
| JP | S5734431 | A | | 2/1982 |
| JP | 57088710 | A | * | 6/1982 |
| JP | S5921009 | A | | 2/1984 |
| JP | S5988809 | A | | 5/1984 |
| JP | 63199408 | A | * | 8/1988 |
| JP | 2003185690 | A | * | 7/2003 |

OTHER PUBLICATIONS

International Preliminary Report on Patentability Application No. PCT/EP2015/050997 Completed: Apr. 4, 2016 7 pages.
International Search Report & Written Opinion of the International Searching Authority Application No. PCT/EP2015/050997 Completed: May 11, 2015; Mailing Date: May 20, 2015 11 pages.
Written Opinion of the International Preliminary Examining Authority Application No. PCT/EP2015/050997 Mailing Date: Jan. 25, 2016 7 pages.

* cited by examiner

DEVICE COMPRISING A HIGH VOLTAGE APPARATUS INCLUDING A FLUID AND EQUIPMENT FOR DETECTING ONE OR MORE PHYSICAL PROPERTIES OF THE FLUID

TECHNICAL FIELD

The present invention relates to a device comprising a high voltage apparatus having a housing enclosing a fluid for providing cooling and/or electrical insulation of the apparatus, and equipment adapted to detect one or more physical properties of the fluid.

BACKGROUND

Malfunctioning of high voltage apparatus, such as transformers and on load tap changer (OLTC), can be both dangerous and expensive. Failure of the apparatus may cause an explosion and damage other equipment and humans.

High voltage apparatus, i.e. apparatus having a system voltage of more than 6 kV, often uses a fluid providing cooling and/or electrical insulation of the apparatus. In many apparatus such as transformers, electrical coils are encapsulated in a housing, which is filled with a fluid. The fluid is used for dissipation of heat while at the same time have an insulating functionality. Examples of such fluids may be oils, such as vegetable oil, mineral oil or synthetic or natural esters, or a gas, such as SF6.

In order to monitor normal behavior or to protect and detect malfunction of the apparatus, physical properties of the fluid, such as moisture content, hydrogen content, and pressure, are measured and supervised on-line, i.e. while the apparatus is in operation. Normal function or malfunction of the apparatus is monitored or detected based on the measured properties. The physical properties of the fluid may indicate that a fault or explosion has taken place. Detector equipment, such as sensors and other measuring utilities are positioned on the apparatus. To prevent the occurrences of incorrect reading or false trip of the apparatus or the system inspection and maintenance or calibration are regularly performed on the apparatus using detector equipment to ensure that the apparatus works correctly. For safety reasons and considering the high electrical potential in the area, the apparatus must be taken out of operation before such work can be performed. To be able to carry out inspection and maintenance or calibration of the encapsulated parts of the high voltage apparatus, the apparatus also has to be taken out of operation. However, to take a high voltage apparatus, such as a transformer, out of operation is time-consuming and costly, and therefore should be avoided. For modern transformers and tap changers, controls of the encapsulated parts of the apparatus are typically needed about every 10 to 15 years. However, control of the detector equipment is often needed more frequently, for example every 2 to 5 years.

Tap changers are used for controlling the output voltage of a transformer by providing the possibility of switching in or switching out additional turns in a transformer winding. A tap changer comprises a set of fixed contacts, which are connectable to a number of taps of a regulating winding of a transformer, where the taps are located at different positions in the regulating winding. A tap changer further comprises at least one moveable contact, which is connected to a current collector at one end, and connectable to one of the fixed contacts at the other end. By switching in or out the different taps, the effective number of turns of the transformer can be increased or decreased, thus regulating the output voltage of the transformer.

The regulating winding is typically not part of the tap changer, but forms part of the transformer. For example, the regulating winding is typically immersed in a transformer fluid, e.g. oil or SF6, while the tap changer is insulated with a separate insulation fluid. By separating the insulation fluids, the risk that the transformer is contaminated by dirt etc. from the tap changer is reduced. Hence, some type of barrier board is typically placed between the regulating winding and at least part of the tap changer, the barrier board preventing the two insulation fluid volumes from mixing. High voltage transformer tanks are very large. In order to reduce the volume of the transformer tank, the tap changer is sometimes mounted on the outside of the transformer tank, in a separate tap changer tank, which is mechanically attached to the transformer tank. But more commonly, a tap changer head is positioned on top of the transformer tank and the rest of the tap changer is placed inside the transformer tank.

Detector equipment for a tap changer may include a pressure relay designed to react on a pressure wave generated from a severe fault within the oil volume of the tap changer. The detector equipment for a tap changer may further include a pressure relief device, an oil flow relay, gas sensor, and/or a moisture sensor. The detector equipment is normally placed directly on or above the tap changer that is assembled on top of the transformer tank. Some of these transformer tanks have a height of several meters from the ground level. In order to reach the detector equipment, a technician needs to reach the top of the apparatus.

US2012/024187 discloses a sensor assembly for a sensor measuring the hydrogen concentration in an insulating fluid in an electric power generation, transmission and distribution apparatus. The sensor is mounted in a tube having a valve for blocking the oil flow while inspecting the sensor. The tube is extending into the apparatus to provide access to the interior of the apparatus and accordingly to the fluid. The tube forms an enclosure for the sensor. During inspection of the sensor, the sensor can be removed from the tube from the outside of the apparatus. The valve is used to block the oil flow after the sensor has been removed. However, it is still necessary to turn off the apparatus during inspection and maintenance of the sensor.

US2011/0093216 discloses a system comprising a container including an expansion tank arranged above a transformer and a pipe containing insulation fluid arranged between the container and the transformer. The container is partially filled with insulation fluid. A temperature sensor and a relative humidity sensor are positioned in the container. The temperature sensor is positioned in the insulation fluid and measures the temperature of the fluid in the container, and the relative humidity sensor is positioned in a gas above the insulation fluid and measures the humidity of the fluid. The temperature is measured in several positions in the container. Thereby, a temperature change within the insulating fluid representative to the whole container can be determined.

EP2 490 011 discloses a device that measures gas present above the insulation fluid in a transformer. The measurements are performed on top of the transformer.

CH212727 discloses a device for measuring pressure in insulation fluid in a transformer. The fluid is conducted in a pipe towards an extension vessel arranged above the transformer. A pressure sensor is present in the pipe that contains the fluid. The sensor is positioned above the housing of the transformer.

JP59021009 discloses a system for filtering particles from insulation oil of a transformer. The oil is conducted in a pipe outside the housing through a filter and conducted back into the housing. A pump on the pipe provides the power needed for conducting the fluid back into the housing. Pressure is measured using a sensor on top of the housing. JP56101718 discloses a system for cooling insulation oil of a transformer. The oil is conducted in a pipe outside the housing through a cooler and conducted back into the housing. A pump on the pipe provides the power needed for conducting the fluid back into the housing. The amount of particles in the fluid are measured before the fluid enters the housing.

JP56101718, discloses a system for cooling insulation oil of a transformer. The oil is conducted in a pipe outside the housing through a cooler and conducted back into the housing. A pump on the pipe provides the power needed for conducting the fluid back into the housing. The amount of particles in the fluid are measured before the fluid enters the housing.

SUMMARY

It is an object of the present invention to provide a device which makes it possible to carry out inspection, testing, maintenance, and calibration of the detector equipment without taking the high voltage apparatus out of operation.

This object is achieved by a device as defined in the independent claim.

The device includes a high voltage apparatus comprising a housing enclosing a fluid for providing cooling and/or electrical insulation of the apparatus, and a detector equipment adapted to detect one or more physical properties of the fluid and positioned spaced apart from the housing, and the device comprises a pipe assembly for housing a fluid, whereby the pipe assembly is arranged between the detector equipment and the housing such that the fluid is extended without interruption in the pipe assembly, the fluid in the pipe assembly is in communication with the fluid in the housing, and the detector equipment is in communication with the fluid in the pipe assembly. The device is characterized in that the detector equipment is positioned below an top portion of the housing at a distance from the housing, wherein the distance is at least 1 m. The fluid is measured at a level that is lower than the top level of the housing.

The present invention allows the detector equipment to be positioned in a remote location away from the high voltage apparatus, where the detector equipment can be tested, checked or calibrated without taking the apparatus out of operation. Since the inspection, maintenance or calibration on the detector equipment can be performed at a distance from the high voltage apparatus without danger for the person performing the inspection and maintenance, the high voltage apparatus does not need to be put out of operation during the inspection. Thereby, time and money are saved.

The idea of the invention is based on the realization that detector equipment, adapted to detect one or more physical properties of a fluid, can be moved to a remote location at a safe distance from the housing of the apparatus as long as the detector equipment is in communication with the fluid in which a fault or explosion may take place, and the fluid inside the pipe assembly is allowed to flow without interruption of obstacles in the pipe assembly, such as pumps, valves, membranes, filters, coolers, and the like.

This assures that the property to be measured is transferred directly through the pipe assembly all the way to the detector equipment. Suitable properties to be measured are, for example, light, pressure, moisture, and gas content in the fluid. Due to the long distance, the fluid in the pipe assembly will be cooled before it is measured. Thus, it is difficult to measure the temperature of the fluid in the housing with sufficient accuracy at a remote distance, without extensive thermal insulation of the pipes.

The insulation fluid, in which the faults are indicated, are prolonged through a pipe towards a point where it is more practical and safe to detect the properties of the fluid, for example, to detect a sound wave from an explosion. The detector equipment can also be put in a protected environment, e. g. inside a motor drive cabinet of an on load tap changer. Thus, an advantage of the device of the present invention is that such work can be carried out at a safe distance from the apparatus.

The apparatus is, for example, a high voltage transformer or an on load tap changer where a physical property is needed to be measured at a non-reachable position during normal operation. During operation, the pipe assembly is filled with fluid. In this way, the detector equipment is in direct communication with the fluid used in the high voltage apparatus. The advantage of arranging the detector equipment on a lower level is that it can easily be reached by a technician standing on the ground during for testing and inspection. Most detectors and other measuring utilities are today positioned on top of the apparatus. The openings present on the top of the apparatus can be used for connecting the first end of the pipe assembly. The detector equipment can advantageously be positioned at a lower level, e.g. a ground level, at a convenient and safe distance from high voltage apparatus. Thus, there is no need to reach the top of the transformer tank.

With a pipe assembly is meant one or more pipes connected to each other to form a channel for housing the fluid. The term "fluid" is meant to include any liquid, such as vegetable oil, mineral oil or synthetic or natural esters, or gases, such as SF6.

The detector equipment can be adapted for control, detection, or measurement of the physical properties of the fluid.

According to an embodiment of the invention, the detector equipment is in direct contact with the fluid in the pipe assembly. This means that detector performs measurements directly on the fluid, and not on another media in contact with the fluid. The property of the fluid is measured directly in the insulation fluid, and not in a gas present above the fluid. Due to the fact that the detector equipment is positioned below an upper level of the fluid in the housing, there is no gas present in the end of the pipe assembly.

According to an embodiment of the invention, the detector equipment comprises one or more detectors for detecting pressure, moisture, gas, or light in the fluid. The detectors can, for example, be sensors for measuring the physical property, or relays reacting when the physical property exceeds a limit value. The delay in detection time due to an increased distance between the apparatus and the detector equipment is not critical for measuring any of the properties moisture, gas, or light, as will be explained in more detail below.

According to a further embodiment of the invention, the detector equipment comprises a gas or moisture sensor for measuring the content of gas or moisture in the fluid. The gas sensor is, for example, a hydrogen sensor adapted to measure the content of hydrogen in the fluid. The content of hydrogen in the fluid gives an indication of aging of the apparatus. A moisture sensor is used to measure the content of moisture in oil. When the content of moisture in the oil exceeds a limit value, the oil has to be changed. According to this embodiment of the invention, a gas and/or a moisture sensor are located at a remote location from the high voltage apparatus, where the sensors can be tested and checked without taking the apparatus out of operation. It works by prolonging the fluid, in which the gas and/or moisture content are to be measured, through a pipe assembly towards a point where it is safe and more practical to measure.

This embodiment of the invention takes advantage of the theoretical property of diffusion. Gas and moisture diffuse in the fluid and are transported with the fluid through the pipe assembly all the way towards the detector equipment. Due to the theory of diffusion, the diffusion makes gas and moisture to be evenly spread within the fluid. If the fluid is extended without interruption in a pipe assembly, the diffusion makes the gas and moisture content to become the same along the pipe assembly towards the moisture or gas sensor. Thus, when a pipe assembly filled with fluid is connected to the apparatus, in direct contact with the fluid in the apparatus and the fluid flows without any interruption by other media (e.g. valves, membranes, filters and the like), the diffusion makes the same gas and moisture content follow the pipe assembly, and can thereby be detected in an severe distance from the source with the only disadvantage of the loss of detection time. The detection time is dependent on the diffusion speed in the fluid, which depends on the viscosity of the fluid and the distance. Sensors placed at a distance up to 5 m give an estimated time delay in the range of days. However, this is fast enough for this type of measurement that normally refers to changes over weeks, month or even years.

According to an embodiment of the invention, the detector equipment comprises a pressure relay or a pressure sensor for detecting a sound wave in the fluid. If there is an explosion in the electrical apparatus, this will create a sound wave that is propagated in the fluid. By detecting an increase in pressure due to the sound wave, it is possible to detect that an explosion in the electrical apparatus has occurred and to take necessary measurements. The advantage of locating the pressure relay/sensor at a remote location away from the high voltage apparatus is that it can be tested and inspected without taking the high voltage apparatus out of operation. This is made possible by prolonging the insulation fluid, in which the pressure is to be detected, through a pipe assembly towards the point where it is more practical to detect the sound wave from the explosion.

The pressure relay is designed to react on a pressure wave generated from a severe fault within the apparatus. This embodiment of the invention takes advantage of the theoretical property of a pressure wave. According to the theory, a pressure wave will spread with the speed of sound within the media where the sound is generated. When the sound reaches a material with another density or shape some sound will bounce and thereby damp the sound impulse. But if the media can be extended without interruption for example in a pipe, the sound wave that hit the pipe inlet follows this media towards the pressure relay/sensor. Thus, by connecting a pipe assembly, filled with the same fluid as the apparatus, to the apparatus in directly communication with the fluid inside the apparatus, without any interruption in the fluid flow, the pressure wave will follow the pipe assembly, and the pressure wave can thereby also be detected in an severe distance from the source with the only disadvantage of the loss of detection time that is dependent on the speed of sound in the media (1320 m/s in mineral oil) and the distance. If the pressure relay/sensor is placed at a distance up to 5 m, the estimated time delay is maximum 4 ms. This can be compared to the reaction time to break open the AC trip circuit in the pressure relay that probably is in the range of 2-12 ms, and the reaction time of the circuit breaker for taking the transformer out of operation that probably is in the range of 100 ms.

According to another embodiment of the invention, the pipe assembly comprises a pipe portion having a first end connected to the housing and a second end located at a distance from the housing, and the device comprises an oil sample valve arranged together with the detector equipment at the second end of the pipe portion. It is advantageous to locate an oil sampling valve at the same position as the detector equipment to reduce the number of pipes needed around the high voltage apparatus and also to gather all inspection points close to each other, since checking the detector equipment, such as the pressure relay, is most advantageously made at the same time as when taking oil samples. The delay in detection due to an increased distance between the apparatus and the detector equipment is not critical, because changes in gas and moisture content of the fluid occur slowly over a time period of weeks or months. Normally oil sampling is performed every 2 to 5 years.

According to an embodiment of the invention, the device comprises an expansion vessel, the pipe assembly extends between the detector equipment and the expansion vessel and the detector equipment comprises a fluid flow detector arranged to detect the fluid flow in the pipe assembly. The expansion vessel is, for example, an oil conservator, and the fluid flow detector is, for example, a flow sensor or a flow relay. This embodiment will minimize the number of pipes that need to be connected to the apparatus, and improves the efficiency of the device. This embodiment also makes it easier for a service technician to reach the flow detector during service and calibration, and makes it possible to provide service and calibration of the flow sensor/relay while the high voltage apparatus is in operation.

According to a further embodiment of the invention, the detector equipment comprises a sensor for detecting light in the fluid. By detecting a sudden increase of light in the fluid, it is possible to detect an explosion or a fault causing an arc in the apparatus. A flash of light will follow the pipe assembly, provided that the inside of the pipe reflects light, such as stainless steel or white painted surface does. The light can thereby also be detected in a severe distance from the source. Due to the high speed of light, the light can be detected at a far distance without any substantial loss of detection time.

Suitably, the distance between the detector equipment and the housing is more than 2 m, to be safe for humans to carry out testing, maintenance or calibration on the detection equipment. Preferably, the distance between the detector equipment and the housing is less than 10 m to be sure that the detection time is not critical. However, the distance needed depends on the system voltage of the apparatus and the requirements on the detection times for the detection equipment. Typically, a safe distance between the detector equipment and the housing is between 2 and 3 m.

During operation of the apparatus, the pipe assembly is filled with fluid in communication with the fluid in the housing. According to another embodiment of the invention, the detector equipment is adapted to detect the one or more physical properties while the apparatus is in operation.

According to another embodiment of the invention, the detector equipment is positioned at a distance of at least 1 m from the housing in a horizontal direction.

According to another embodiment of the invention, said pipe assembly is connected to the housing at a first level and the detector equipment is positioned at a second level below the first level, as seen in relation to a ground level. For example, the pipe assembly comprises a vertically arranged pipe portion.

According to a further embodiment of the invention, the detector equipment is positioned on a ground level. The advantage of putting the detector equipment on ground position is that it can easily be reached by a technician standing on the ground during testing and inspection. There is no need to reach the top of the transformer tank.

According to another embodiment of the invention, the apparatus is an on-load tap changer including a tap changer head positioned on top of a transformer tank, and the pipe assembly is connected between the tap changer head and the detector equipment. Preferably, the detector equipment is arranged at a position below the position of the tap changer head.

According to another embodiment of the invention, the apparatus comprises a circuit breaker adapted for taking the apparatus out of operation, when a measured physical property value is outside a predetermined range of reference values, and a reaction time of the circuit breaker is less than 200 milliseconds. In one embodiment, the reaction time is less than 150 milliseconds.

BRIEF DESCRIPTION OF THE DRAWINGS

The invention will now be explained more closely by the description of different embodiments of the invention and with reference to the appended figure.

DETAILED DESCRIPTION

Figure 1:
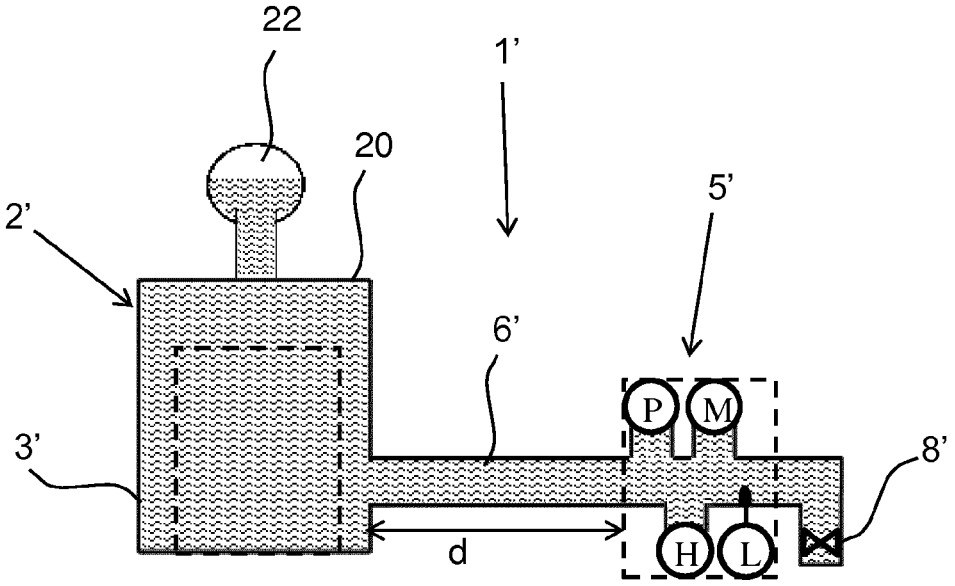
FIG. 1 shows schematically a device according to a first embodiment of the invention.

FIG. 1 shows a device 1' according to a first embodiment of the invention. The device 1' comprises a high voltage apparatus 2' having a housing 3' enclosing a fluid for providing cooling and/or electrical insulation of the apparatus, and detector equipment 5' adapted to detect one or more physical properties of the fluid, and a pipe 6' for housing the fluid is arranged between the detector equipment 5' and the housing 3' such that the detector equipment is arranged in direct communication with the fluid in the pipe and accordingly with the fluid in the housing. In this embodiment, the high voltage apparatus 2' is disposed on the ground, and the detector equipment is disposed on or closed to the ground to allow maintenance personnel to easily reach the detector equipment. The housing 3' has a bottom portion, an upper portion and side walls connected between the bottom and upper portions. The upper portion of the housing defines a top level 20 of the housing. A first end of the pipe 6' is connected the housing 3'. In this embodiment, the first end of the pipe 6' is connected to a side wall of the housing. A second end of the pipe is position at a distance from the housing. The detector equipment 5' is connected to the second end of the pipe. The detector equipment 5' is situated at a distance d away from the housing 3'. In this embodiment, the detector equipment 5' is situated a distance d away from the housing in a horizontal direction. The distance d is preferably more than 1 m to provide a safe distance from the high voltage apparatus and less than 10 m to ensure that the property can be accurately measured. The detector equipment 5' is situated below the upper part of the housing. Preferably, the detector equipment 5' is positioned close to the ground so that maintenance personal easily can reach the equipment.

The pipe assembly is arranged such that when the pipe assembly is filled with fluid, the fluid is extended between the detector equipment and the housing without interruption by other media, e.g. valves, filters and the like, in the pipe assembly. Thus, the fluid is allowed to flows without any interruption between the housing and the detector equipment. The fluid is, for example oil, such as vegetable oil, mineral oil or synthetic or natural esters, or gas, such as SF6. The device may also include two or more detector equipment 5' connected to the pipe at spaced apart positions along the pipe. The device further comprises an expansion vessel 22 arranged above the housing. An expansion vessel must always be positioned above the oil level in the apparatus, otherwise it cannot function as an expansion vessel.

The apparatus 1' is, for example, a high voltage transformer immersed in oil. In this embodiment, the detector equipment 5' includes a pressure relay P, a sensor M for measuring the content of moisture in the fluid, a sensor H for measuring the content of hydrogen in the fluid, and a sensor L for detecting light in the fluid. However, the detector equipment may include a single sensor or a combination of several sensors or relays. For example, the detector equipment may include two or more sensors of the same type arranged along the pipe to achieve redundancy and to enable measurement of the rate of change of one or more physical properties. During operation of the apparatus, the pipe 6' is filled with fluid in communication with the fluid in the apparatus 2'. The detector equipment 5' is adapted to detect physical properties of the fluid in the pipe assembly 6'. In this embodiment of the invention, the device also includes an oil sample valve 8" arranged together with the detector equipment 5' at a second end of the pipe assembly 6'.

Figure 2:
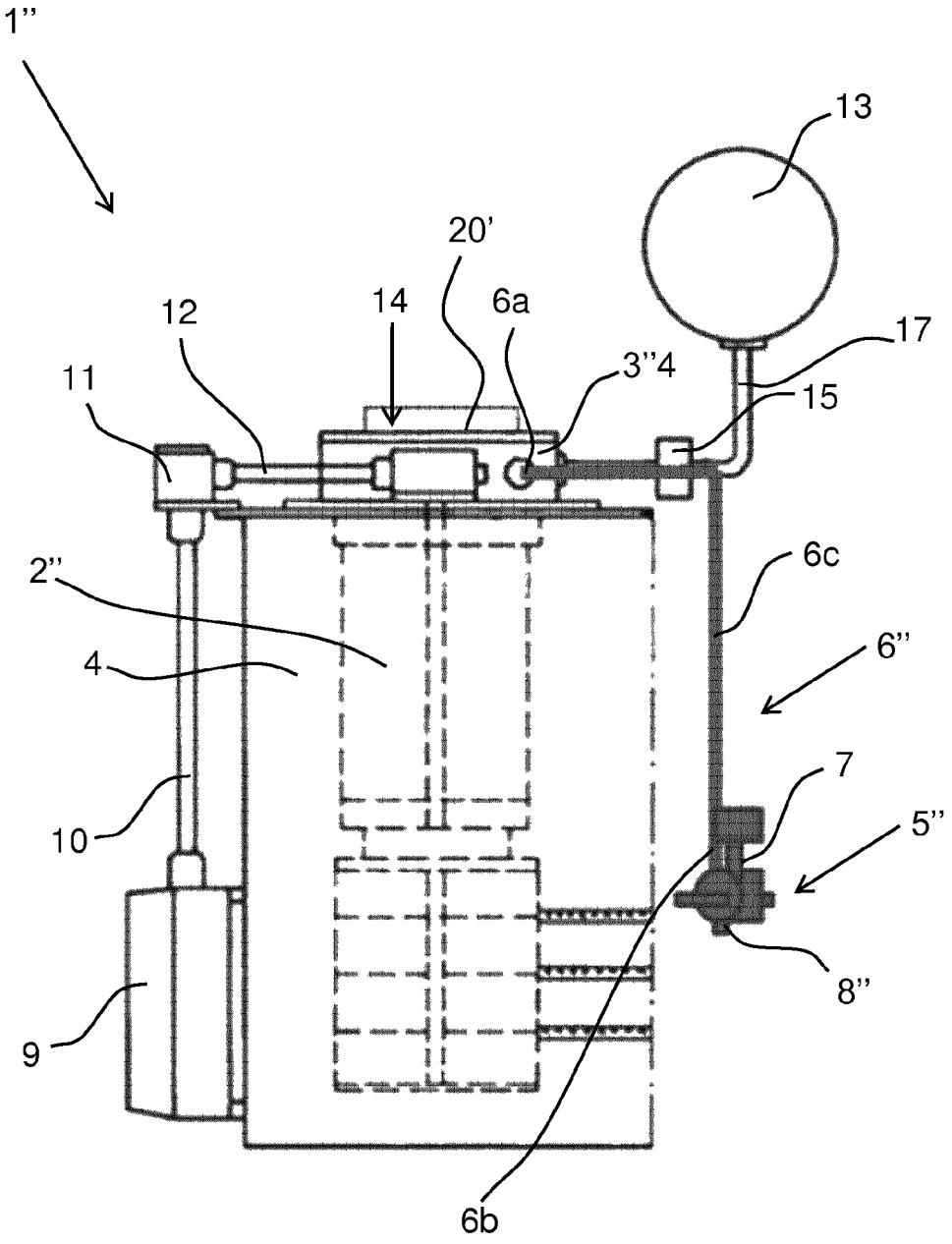
FIG. 2 shows schematically a device according to a second embodiment of the invention including an on load tap changer.

FIG. 2 shows schematically a device 1" according to a second embodiment of the invention. The device 1" comprises a high voltage apparatus 2". In this embodiment, the high voltage apparatus 2" is an on load tap changer (OLTC). The OLTC includes a tap changer head 14. The high voltage part of the OLTC is mounted inside a transformer tank 4 and the tap changer head 14 is mounted on top of the transformer tank 4. The transformer tank 4 is filled with a fluid for providing electrical insulation and cooling of the OLTC and a transformer housed in the tank. The tap changer head 14 forms a compartment filled with fluid in communication with the fluid in the transformer tank 4. The tap changer head 14 comprises a housing 3" enclosing the fluid for providing cooling and/or electrical insulation of the OLTC. The housing 3" has a bottom portion, an upper portion and side walls connected between the bottom and upper portions. The upper portion of the housing defines a top level 20' of the housing 3". The device may further comprise a motor-drive mechanism 9 connected to shafts 10, 12 possibly using a bevel gear 11.

The device further comprises a pipe assembly 6" having a first end **6*a* connected to the housing 3" of the tap changer head 14 and a second end 6*b* connected to detector equipment 5". The pipe assembly 6" may comprise a pipe and connection portions at the first and second ends 6*a*, 6*b* for connecting the pipe to the housing 3" and the detector equipment 5". The pipe is made of any material in which a fluid can be contained, such as metal or plastic. Preferably, the inside of the pipe is made of material that can reflect light. In this embodiment, the fluid is oil. As shown in FIG. 2, the pipe assembly 6" may have a vertically arranged pipe portion 6***c* to contain and connect the fluid from a first level at the first end 6*a*, e.g. on top of the apparatus 2", to a second level at the second end 6*b*, e.g. on a ground level. For convenience, safety and efficiency, the second level is below the first level as seen from the ground level. However, depending on the geometry of the location, the second level may be on substantially the same level. In another embodiment the second level is on a higher level in relation to the ground level on which the apparatus 2" is placed.

The fluid enclosed in the housing 3',3" is used for heat dissipation and insulation of the high voltage apparatus. The fluid is contained in the housing and in the pipe assembly 6, 6" all the way towards the detector equipment 5', 5" without interruption of the fluid flow. In this way, the detector equipment 5,5" is in direct communication with the fluid as used in the high voltage apparatus. Because the fluid flows in a closed system, without openings to open air, the pressure measured by the detection equipment is the pressure of the fluid as it flows through the housing.

The length of the pipe assembly is such that the distance between the housing and the detector equipment is allowed to be sufficiently long for a person to perform inspection and maintenance of the detection equipment in a safe and efficient manner when the apparatus is in operation. The distance should be at least 1 meter, and preferably at least 2 m. Suitably, the distance is less than 10 m.

The detector equipment comprises at least one detector, preferably more than one detector, for control, detection or measurement of one or more physical properties of the fluid. Examples of suitable detectors that can be used in the detector equipment are detectors adapted for measuring pressure and detecting a sound wave in the fluid. Other examples are detectors adapted for detecting a moisture and gas content in the fluid, such as hydrogen and water content. A further example may be a detector adapted for detecting light in the fluid. In this embodiment, the detector equipment includes a pressure sensor or pressure relay 7.

The device 1" may further comprise an expansion vessel 13, such as an oil conservator, and a fluid flow detector 15 for measuring the flow of the fluid. The fluid flow detector 15 is, for example, an oil flow relay or a flow sensor. In this embodiment, the expansion vessel 13 and the fluid flow detector 15 are connected to the OLTC head by means of a separate pipe 17. In FIG. 2, the pressure relief device 14 and the oil flow relay 15 are positioned on top of the apparatus 2".

The detector equipment 5" may also include other measurement utilities, such as an oil sample valve 8", as shown in FIG. 2. The pipe assembly 6" comprises a pipe portion having a first end 6*a* connected to the housing 3" and a second end 6*b* located at a distance from the housing, and the device comprises an oil sample valve 8" arranged at the second end 6*b* of the pipe together with the detector equipment 5".

Figure 3:
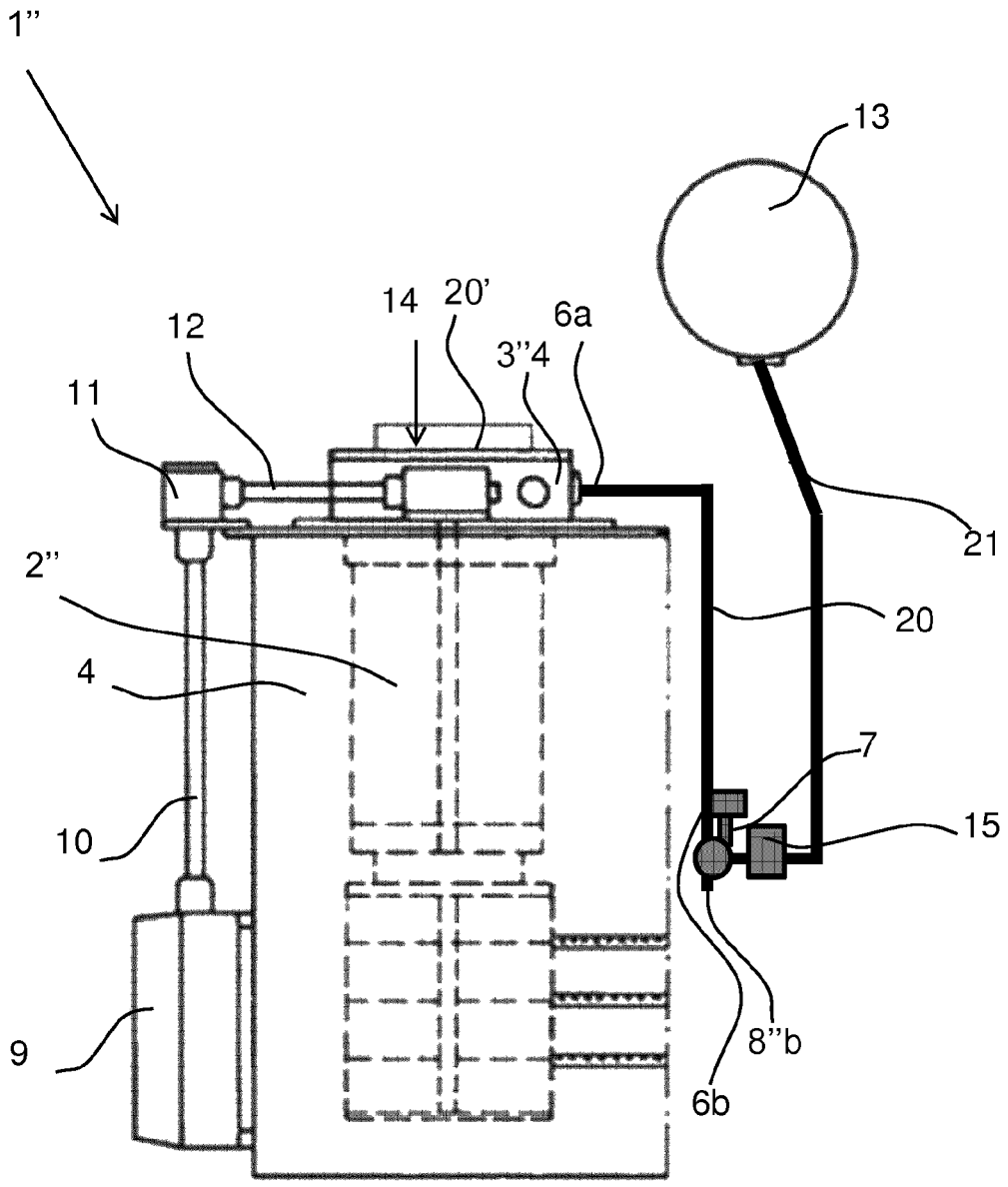
FIG. 3 shows schematically a device according to a third embodiment of the invention.

FIG. 3 shows schematically a device according to a third embodiment of the invention. In this embodiment the device comprises a pipe assembly 19 having a first end 6*a* connected to the housing 3" of the tap changer head 14 and a second end 6*b* connected to the expansion vessel 13. The pipe assembly 19 includes a first pipe portion 20 extending between the housing 3" of the apparatus and the detector equipment 5", and a second pipe portion 21 extending between the detector equipment 5" and the expansion vessel 13. The detector equipment 5" further comprises a fluid flow detector 15 arranged to detect the fluid flow in the pipe assembly 19. In this embodiment, the flow detector is arranged to detect the flow in the second pipe portion 20. This embodiment differs from the previous embodiment in that the expansion vessel 13 and the fluid flow detector 15 are connected to the same piping assembly 19 as the detector equipment 5". The fluid flow sensor 15 is positioned at a level below the tap changer head 14. This embodiment makes it easier for a service technician to reach the flow sensor 15 during service and calibration of the sensor and makes it possible to provide service and calibration of the sensor while the high voltage apparatus is in operation. Further, this embodiment will minimize the number of pipes that need to be connected to the apparatus and improves the efficiency of the device.

In one embodiment, other measurement utilities, for example, the oil flow relay 15 can also be combined with the detector equipment. These other measurement utilities may be positioned in the proximity of the detector equipment, i.e. at a distance from the apparatus, or these measurement utilities may be comprised in the detector equipment.

The device according to the invention can be used for detecting one or more physical properties of a fluid enclosed in a housing of a high voltage apparatus, while the apparatus is in operation. A possible delay in reaction time of a circuit breaker adapted for taking the apparatus out of operation is not critical.

For example, a pressure wave will be spread with a speed of sound within the media where the sound is generated. When the sound wave reached a material with another density or shape, the sound wave will bounce and thereby damp the sound impulse. However, if the media is extended without interruption, for example in a pipe, the sound wave will hit the pipe inlet at the first end 6*a* and follow this media (the fluid) towards the second end 6*b* of the pipe 6 at the detector equipment 5. The pressure or sound wave can thus be detected at a distance from the apparatus 2. The loss of detection time is dependent on the distance and the speed of the sound in the media, which speed is 1320 m/s in mineral oil. If the detector equipment 5 with a sensor for detecting wave sounds is located at a distance of 5 meters, the delay in detection time is about 4 milliseconds. This can be compared to a reaction time for breaking open an AC trip circuit in a pressure relay that is in the range of 2 to 12 milliseconds and a reaction time of the circuit breaker for taking the apparatus 2 out of operation that is in the range of about 100 milliseconds.

Another example regards detecting gas or moisture content in the fluid. Gas and moisture diffuse in the fluid and follow the fluid contained in the pipe assembly. Gas and moisture can thus be detected at a distance from the apparatus. The loss in detection time depends on the diffusion speed in the media with its viscosity at the actual temperature and the distance. If sensors are placed on the ground level, it can be estimated that a distance up to 5 meter will cause a delay in the range of days. These types of measurements are normally today performed manually once every 2 to 5 years. Therefore, a delay of some days or even weeks is not a critical delay. With regard to temperature, the device 1 allows a control of the temperature at the measurement point, i.e. at the detector equipment.

The sensors used for measuring a physical property value may be connected to a protection system arranged to be connected to the circuit breaker or a logger or a monitoring system. The sensors may in the simplest case be adapted to allow values of the physical property to be within a predetermined range of reference values having an upper and a lower limit. If the detected value falls outside the predetermined range, an alarm signal can be initiated, and other types of algorithms taking history into consideration can also be used.

The invention claimed is:

1. A device including a high voltage apparatus comprising:

a housing enclosing a fluid for providing cooling and/or electrical insulation of the apparatus, a detector equipment configured to detect one or more physical properties of the fluid and positioned spaced apart from the housing at a level below a top level of the housing, and a pipe assembly for housing a fluid, the fluid in the pipe assembly is in communication with the fluid in the housing, and the detector equipment is in communication with the fluid in the pipe assembly, wherein the detector equipment is configured to detect any of light, pressure, moisture, or gas content in the fluid, the pipe assembly is arranged such that the fluid inside the pipe assembly flows between the detector equipment and the housing without interruption of obstacles in the pipe assembly, and the detector equipment is positioned at least 1 m away from the housing of the apparatus.

2. The device according to claim 1, whereby the apparatus is a high voltage transformer or an on load tap changer.

3. The device according to claim 1, whereby the detector equipment comprises one or more detectors for detecting pressure, moisture, gas, or light in the fluid.

4. The device according to claim 1, whereby the detector equipment comprises a gas or moisture sensor for measuring the content of gas or moisture in the fluid.

5. The device according to claim 1, whereby the detector equipment comprises a pressure relay or a pressure sensor for detecting a sound wave in the fluid.

6. The device according to claim 1, whereby the detector equipment comprises a sensor for detecting light in the fluid.

7. The device according to claim 1, whereby the pipe assembly comprises a pipe portion having a first end connected to the housing and a second end located at a distance from the housing, and the device comprises an oil sample valve arranged together with the detector equipment at the second end of the pipe portion.

8. The device according to claim 1, whereby the distance between the detector equipment and the housing is at least 2 m.

9. The device according to claim 1, whereby the distance between the detector equipment and the housing is less than 10 meter.

10. The device according to claim 1, whereby the detector equipment is positioned on a ground level.

11. The device according to claim 1, whereby said pipe assembly is connected to the housing at a first level and the detector equipment is positioned at a second level below the first level.

12. The device according to claim 1, whereby the pipe assembly is filled with fluid in communication with the fluid in the housing, and the detector equipment is adapted to detect the one or more physical properties while the apparatus is in operation.

13. The device according to claim 1, whereby the detector equipment is positioned said distance from the housing in a horizontal direction.

14. The device according to claim 1, whereby the apparatus is an on-load tap changer including a tap changer head positioned on top of a transformer tank, the pipe assembly is connected between the on-load tap changer head and the detector equipment, and the detector equipment is arranged at a position below the position of the tap changer head.

15. The device according to claim 1, whereby the device comprises an expansion vessel, the pipe assembly extends between the detector equipment and the expansion vessel, and the detector equipment comprises a fluid flow detector arranged to detect the fluid flow in the pipe assembly.

16. The device according to claim 1, wherein the pipe assembly positioned between the housing and the detector equipment is free of obstacles.

17. The device according to claim 16, wherein the pipe assembly is free of obstacles, the obstacles including valves.

18. The device according to claim 16, wherein the pipe assembly is free of obstacles, the obstacles including filters.

* * * * *